US005361732A

United States Patent [19]

Kamata

[11] Patent Number: 5,361,732

[45] Date of Patent: Nov. 8, 1994

[54] TWO CYCLE INTERNAL COMBUSTION ENGINE

[75] Inventor: Yoshikiyo Kamata, Tokyo, Japan

[73] Assignee: Kioritz Corporation, Tokyo, Japan

[21] Appl. No.: 162,834

[22] Filed: Dec. 6, 1993

Related U.S. Application Data

[63] Continuation of Ser. No. 969,133, Oct. 30, 1992, abandoned.

[30] Foreign Application Priority Data

Nov. 21, 1991 [JP] Japan ..... 3-103659[U]

[51] Int. Cl.[5] ..... F02B 27/04

[52] U.S. Cl. ..... 123/65 PE; 60/301

[58] Field of Search ..... 123/65 P, 65 PE; 60/274, 288, 301

[56] References Cited

U.S. PATENT DOCUMENTS

| | | | |
|---|---|---|---|
| 3,240,194 | 3/1966 | Rychlik . | |
| 3,810,361 | 5/1974 | Weaving et al. | 60/301 |
| 4,903,482 | 2/1990 | Overington et al. | 123/65 PE |
| 4,920,931 | 5/1990 | Klomp | 123/65 PE |
| 4,924,820 | 5/1990 | Lear et al. | 123/65 PE |
| 4,938,178 | 6/1990 | Schlunke et al. | 123/65 PE |
| 4,969,329 | 11/1990 | Bolton et al. | 123/65 PE |
| 5,000,131 | 3/1991 | Masuda | 123/65 PE |

FOREIGN PATENT DOCUMENTS

| | | | |
|---|---|---|---|
| 48-31318 | 4/1973 | Japan . | |
| 0253114 | 10/1988 | Japan | 123/65 PE |
| 64-19108 | 1/1989 | Japan . | |

*Primary Examiner*—Noah P. Kamen
*Attorney, Agent, or Firm*—Bauer & Schaffer

[57] ABSTRACT

A two cycle interal combustion engine constituting of upper exhaust ports and a lower exhaust port provided on the upper and the lower of the level of the upper edge of scavenging ports, respectively, and having only the upper exhaust ports connected to a cleaning device. As a result of that, exhaust gas containing large amounts of hazardous components is mainly discharged from the upper exhaust ports and, because the exhaust gas can be cleaned concentratively, the decontamination efficiency of exhaust gas is good.

1 Claim, 2 Drawing Sheets

TWO CYCLE INTERNAL COMBUSTION ENGINE

This is a continuation of Ser. No. 07/969,133, filed Oct. 30, 1992 now abandoned

BACKGROUND OF THE INVENTION

This invention relates to a two cycle internal combustion engine, particularly to a two cycle internal combustion engine having improved power performance and decontamination efficiency of exhaust gas.

In the two cycle engine constituted with a scavenging port and an exhaust port formed on the side surface of a cylinder and having a mechanism in which these ports are closed and opened by a piston, after burst of mixture of fuel and air the exhaust port is opened when the piston descended to a certain position and then discharge of the combusted gas is initiated by the internal pressure of the cylinder. When the piston descended further to the next position, the scavenging port is opened, thereby fresh mixture compressed in a crank chamber flows into and fill the cylinder by scavenging the combusted gas remaining in the cylinder. When the piston turned to ascending, first the scavenging port is closed and then the exhaust port is closed to complete the change of gas in the cylinder.

This type of two cycle engine has a defect that the amounts of discharge of CO (carbon monoxide) and HC (hydrocarbon) are high, because a part of both the combusted gas containing CO and the mixture containing HC flowed in from the scavenging port is exhausted from the exhaust port into the atmosphere. To improve the defect mentioned above, it is essential to install an additional cleaning device such as a catalytic converter in the exhaust system to decontaminate the exhaust gas by reprocessing HC and incompletely combusted gas.

Thus, it is desirable for improvement of the decontamination efficiency of the exhaust gas to conduct a concentrate post-treatment by separating and trapping only the exhaust gas containing large amounts of hazardous components to be treated such as HC, CO and the like.

SUMMARY OF THE INVENTION

The object of this invention is to provide a two cycle internal combustion engine having improved decontamination efficiency of the exhaust gas by separating and trapping the exhaust gas containing large amounts of hazardous components and subsequent reprocessing the exhaust gas trapped, and also improved power performance of the engine.

In order to attain the aforementioned object, this invention is provided with, in a two cycle internal combustion engine having at least one scavenging port and at least one exhaust port which are placed on the side surface of a cylinder and being opened and closed by a piston, an upper exhaust port provided their lower edge on the same level as the upper edge of the scavenging port and a lower exhaust port provided its upper edge on the same level as the upper edge of the scavenging ports by dividing the exhaust port, and connecting only the upper exhaust port to an additional cleaning device.

According to this invention, by descending of the piston during the expansion stroke, first the upper exhaust port will open from its upper edge and thereby the combusted gas with high temperature and high pressure flows out from the upper exhaust port by the internal pressure of the cylinder. Because the upper exhaust port is connected to the cleaning device, said combusted gas will be decontaminated by the cleanig device. This portion of the combusted gas contains a large amount of CO, therefore it becomes possible to collect only a portion of combusted gas containing a large amount of CO from the upper exhaust port and to perform a concentrative cleaning of the exhaust gas, thereby the decontamination efficiency is improved.

By further descending of the piston, the upper exhaust port is completely opened and simultaneously the scavenging port and the lower exhaust port start to open from their upper edges to supply the fresh mixture from the scavenging port into a combustion chamber in the cylinder. This mixture scavenges the combusted gas remaining in the combustion chamber through the upper and lower exhaust ports.

Meantime, during the ascending movement of the piston from the bottom dead center, first the scavenging port and the lower exhaust port are simultaneously closed. And simultaneously with complete closing of both the scavenging port and the lower exhaust port, the upper exhaust port starts to close, from where a small amount of unburnt mixture containing a large amount of HC is discharged. However, the discharged unburnt is decontaminated by the cleaning device connected to the upper exhaust port.

DETAILED DESCRIPTION OF THE PREFERRED EMBODIMENT

Followings are detailed description of an embodiment of this invention based on the drawings.

Figure 1:
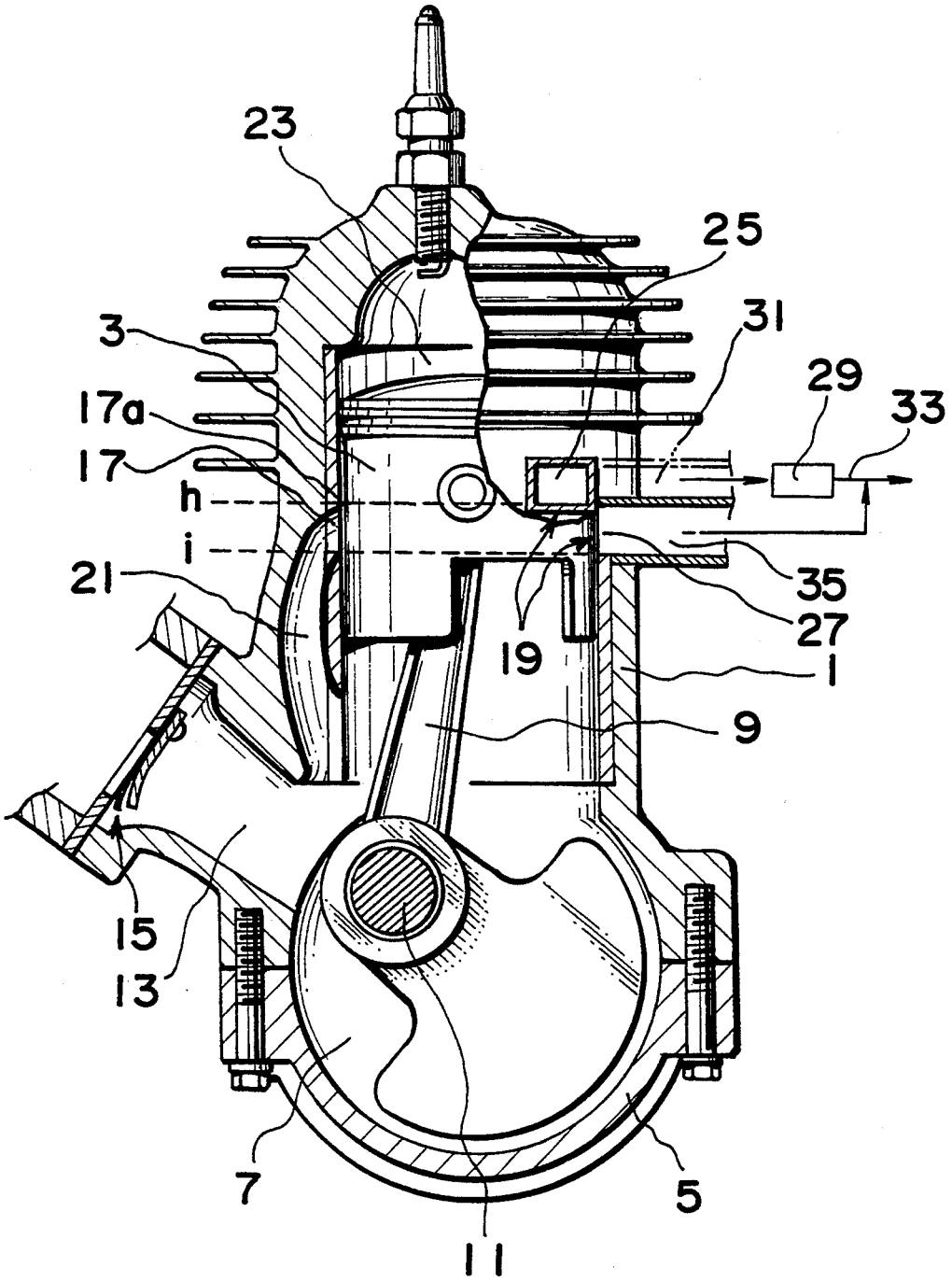
FIG. 1 is a sectional view showing an embodiment of this invention.

FIG. 1 is a sectional view showing an embodiment of this invention. In FIG. 1, the numeral 1 is a cylinder, 3 is a piston which moves reciprocally in the cylinder 1, 5 is a crank case fixed to the bottom of the cylinder 1, 7 is a crank chamber formed with the crank case 5, 9 is a connecting rod of which one end is jointed to the piston 3 and another end is jointed to a crank pin 11 provided in the crank chamber 7, and 13 is an inlet path to supply mixture of fuel and air from a carburetor (not shown in the drawing) through a lead valve 15 to the crank chamber 7.

On the side surface of the cylinder 1, scavenging ports 17 and exhaust ports 19, which are opened and closed by the piston 3, are formed with rectangular shape of opening.

The scavenging ports 17 lead to the crank chamber 7 through a scavenging path 21. Therefore, the mixture sucked into the crank chamber 7 through the inlet path 13 by the negative pressure in the crank chamber 7 due to the ascending movement of the piston 3 is pre-compressed in the crank chamber 7 by the descending movement of the piston 3 and, when the scavenging ports 17 are opened, the compressed mixture is introduced into a combustion chamber 23 formed on the upper of the piston 3.

The exhaust ports 19 are constituted with two left and right side upper exhaust ports 25 and 25 provided each on the same level as the upper edge 17*a* of the scavenging ports 17 and one larger lower exhaust port 27 provided between the upper exhaust ports 25 and 25 on the same level as the scavenging ports 17.

Figure 2:
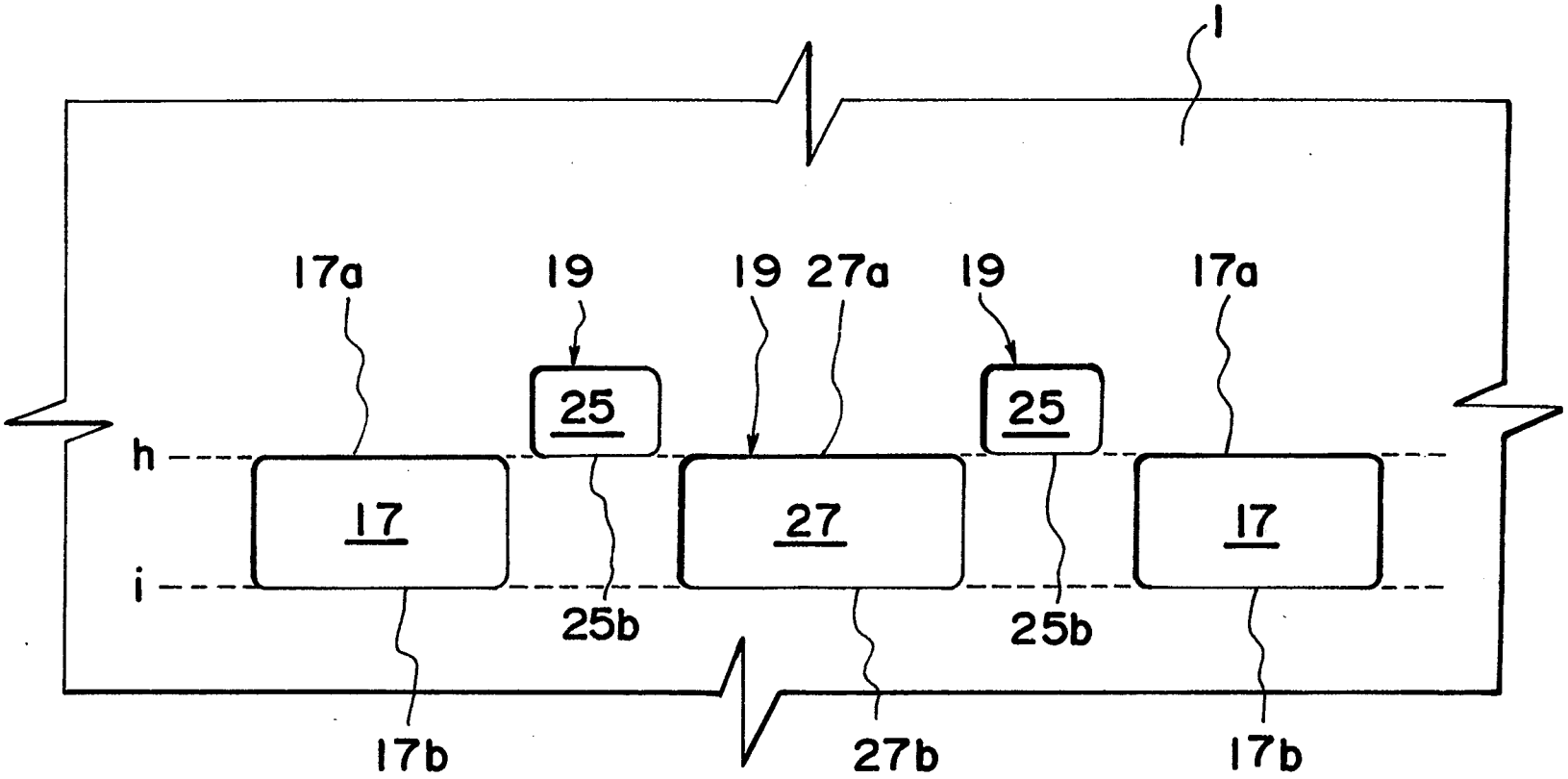
FIG. 2 is a simplified development of the cylinder shown in Fig.1.

FIG. 2 is a simplified development of the cylinder showing the positional relationship between each port formed on the side surface of the cylinder 1.

As evident from FIG. 2, in this embodiment, each port is formed so that the level h of the upper edge 17*a* of the scavenging ports 17 corresponds to the level of the lower edge 25*b* of the upper exhaust ports 25 and the upper edge 27*a* of the lower exhaust port 27, and also the level i of the lower edge 17*b* of the scavenging ports 17 corresponds to the level of the lower edge 27*b* of the lower exhaust port 27.

And, the upper exhaust ports 25 are connected through upper exhaust paths 31 to a catalytic converter 29 having a function as an additional cleaning device and located at the down stream of the exhaust line. The combusted gas exhausted from the upper exhaust ports 25 is subjected to post-treatment in the catalytic converter 29 and consequently discharged through a exhaust pipe 33 to the atmosphere. On the other hand, a lower exhaust path 35 extending from the lower exhaust port 27 is directly connected to the exhaust pipe 33 at the down stream from the catalytic converter 29.

According to the engine of this embodiment constituted as described above, first the upper exhaust ports 25 are opened by the descending movement of the piston 3 during the expansion stroke and the combusted gas with high temperature and high pressure flows out from the opened upper exhaust ports 25. This gas contains large amounts of hazardous components such as CO and the like, however it is discharged to the atmosphere after decontaminated by reprocessing in the catalytic converter 29 because the upper exhaust ports 25 are connected to the catalytic converter 29.

When the piston descended further, the upper exhaust ports 25 are completely opened and simultaneously the lower exhaust port 27 and the scavenging ports 17 start to open. At this time, the combusted gas remained in the combustion chamber 23 is scavenged by the pre-compressed mixture introduced into the combustion chamber 23 from the scavenging ports 17 and discharged mainly from the lower exhaust port 27. At this time, almost of all combusted gas with high temperature and high pressure has already been discharged from the upper exhaust ports 25, therefore only a small portion of the combusted gas is remaining in the combustion chamber 23 and the content of hazardous components in the exhaust gas is relatively low.

On the other hand, when the piston 3 is turned from the bottom dead center to ascending, both the scavenging ports 17 and the lower exhaust port 27 are simultaneously closed. And, simultaneously with the complete close of both the scavenging ports 17 and the lower exhaust port 27, the upper exhaust ports 25 start to open. At this time, only small portion of the mixture newly supplied into the combustion chamber 23 leaks from the upper exhaust ports 25 because they are already partially closed. This leaked gas, however, is decontaminated by the catalytic converter 29, therefore such problem that hazardous components such as HC and the like contained in the leaked gas are directly discharged to the atmosphere does not occur.

According to this invention constituted as aforementioned, because the exhaust gas containing large amounts of hazardous components to be decontaminated is discharged mainly from the upper exhaust ports 25, there is an advantage that the decontamination of exhaust gas can be conducted efficiently by the concentrative post-treatment. Also, because the exhaust ports are constituted with the upper exhaust ports 25 and the lower exhaust port 27 having a large opening area, the exhaust efficiency is good and, as a result of that, there is an advantage that the power performance is high.

What is claimed is

1. In a two cycle internal combustion engine having a cylinder piston and a scavenging port and an exhaust port opened to the side of said cylinder and being closed by said piston, said engine being characterized in that said exhaust port is divided into a pair of upper exhaust openings having their lower edges at the same level as the upper edge of said scavenging port and a lower exhaust opening having its upper edge at the same level as said upper edge of said scavenging port, only said upper exhaust openings being connected to an exhaust cleaning device, said upper and lower exhaust openings being radially offset from each other and said upper exhaust openings being located radially between said scavenging port and said lower exhaust opening.

* * * * *